US007087864B2

(12) United States Patent
Oh et al.

(10) Patent No.: US 7,087,864 B2
(45) Date of Patent: Aug. 8, 2006

(54) COOKING DEVICE

(75) Inventors: Keun Seuk Oh, Suwon-Si (KR); Hyang Ki Kim, Suwon-Si (KR); Kyoung Ho Kim, Suwon-Si (KR)

(73) Assignee: Samsung Electronics Co., Ltd., Gyeonggi-Do (KR)

( * ) Notice: Subject to any disclaimer, the term of this patent is extended or adjusted under 35 U.S.C. 154(b) by 0 days.

(21) Appl. No.: 11/154,729

(22) Filed: Jun. 17, 2005

(65) Prior Publication Data

US 2006/0118542 A1 Jun. 8, 2006

(30) Foreign Application Priority Data

Dec. 8, 2004 (KR) ..... 10-2004-0103120

(51) Int. Cl.
*A21B 1/00* (2006.01)

(52) U.S. Cl. ..... 219/400; 219/401; 219/388; 219/413; 126/20; 126/21 A; 126/22; 99/474; 99/475; 99/476

(58) Field of Classification Search ..... 219/400, 219/401, 388, 413; 126/20, 21 A, 22; 99/474–476
See application file for complete search history.

(56) References Cited

U.S. PATENT DOCUMENTS 4,626,661 A * 12/1986 Henke ..... 219/400

FOREIGN PATENT DOCUMENTS

| | | | |
|---|---|---|---|
| JP | 59-202333 | A | 11/1984 |
| JP | 08-247473 | A | 9/1996 |
| JP | 2002-071139 | A | 3/2002 |
| KR | 100172315 | B1 | 10/1998 |

* cited by examiner

*Primary Examiner*—Shawntina Fuqua
(74) *Attorney, Agent, or Firm*—Sughrue Mion, PLLC

(57) ABSTRACT

A cooking device is provided which blows most of the air blown from a circulation fan in a heater room to a heater, such that the heating of air by the heater is facilitated and the volume of the rear side of a heater case is reduced to permit manufacture of the cooking device in a small size. The cooking device includes a heater case provided to form a heater room in an inner case, a circulation fan installed in the heater room, a heater installed outside of the circulation fan in the heater room, a motor mounted outside the heater case and driving the circulation fan, and a first sunken part formed such that a portion of the heater case, on which the motor is mounted, is sunken inward with respect to the heater room by a predetermined depth.

3 Claims, 3 Drawing Sheets

COOKING DEVICE

CROSS-REFERENCE TO RELATED APPLICATION

This application claims priority from Korean Patent Application No. 2004-103120, filed on Dec. 8, 2004 in the Korean Intellectual Property Office, the disclosure of which is incorporated herein by reference.

BACKGROUND OF THE INVENTION

1. Field of the Invention

The present invention relates to a cooking device and, more particularly, to a cooking device in which heat exchange by a heater is enhanced and a mounting space for a motor for driving a circulation fan is reduced.

2. Description of the Related Art

Conventional cooking devices, as disclosed in Japanese Patent Laid-Open Nos. 8-247473 and 2002-71139, include a heater case sunken from the rear of a cooking chamber to a predetermined depth to form a heater room, a centrifugal circulation fan installed in the heater room to circulate internal air of the cooking chamber, a heater installed outside the heater room to heat the circulated air, and a motor mounted outside the heater case (outside the heater room) to drive the circulation fan.

In the cooking device, air is circulated such that, when the motor drives the circulation fan in the heater room, air in the cooking chamber is sucked through the central portion of the circulation fan and is expelled by the circulation fan into the heater room, and is supplied into the cooking chamber again after being heated by the heater installed outside the circulation fan. Thus, air in the cooking chamber is heated to a high temperature such that food placed in the cooking chamber is cooked.

However, since such cooking devices are structured such that an inner surface of the heater case for forming the heater room is planar and the centrifugal circulation fan is installed near the inner surface of the heater case, heat exchange between air blown toward the outside of the heater room by the circulation fan and the heater is not effective. In other words, due to a large quantity of air detouring the heater and being blown toward the circulation fan, the heater ineffectively heats the air.

Moreover, the conventional cooking device has shortcomings in that, since the motor, mounted on the rear surface of the heater case, is significantly protruded rearward due to the planar rear surface of the heater case to form the heater room, the motor occupies a wide rear space of the cooking device. In other words, in the conventional cooking device, since the heater case protrudes rearward and the motor mounted on the rear surface of the heater case also protrudes, the volume of the rear side of the heater case is large.

SUMMARY OF THE INVENTION

Illustrative, non-limiting embodiments of the present invention overcome the above disadvantages and other disadvantages not described above. Also, the present invention is not required to overcome the disadvantages described above, and an illustrative, non-limiting embodiment of the present invention may not overcome any of the problems described above.

The present invention has been made in view of the above-mentioned problem, and an aspect of the invention is to provide a cooking device for blowing most of the air blown from a circulation fan in a heater room to a heater such that the heating of air by the heater is facilitated.

It is another aspect of the present invention to provide a cooking device capable of being manufactured in a small size by reducing the volume of the rear side of a heater case.

In accordance with one aspect, the present invention provides a cooking device including an inner case, a heater case provided in the inner case to form a heater room, a circulation fan installed in the heater room, a heater installed outside of the circulation fan in the heater room, a motor mounted outside the heater case and driving the circulation fan, and a first sunken part formed such that a portion of the heater case, on which the motor is mounted, is sunken inward with respect to the heater room by a predetermined depth.

A part of the motor may be accommodated in the first sunken part.

The heater case is integrally formed with the first sunken part.

Moreover, the heater is aligned in the air blowing direction of the circulation fan.

In addition, the cooking device of the present invention further includes a rear plate spaced apart from an outer surface of the heater case and insulating the outer surface of the heater case. The rear plate has a second sunken part corresponding to the first sunken part and sunken inward with respect to the heater room, and a part of the motor is accommodated in the second sunken part of the rear plate.

Additional aspects and/or advantages of the invention will be set forth in part in the description which follows and, in part, will be apparent from the description, or may be learned by practice of the invention.

BRIEF DESCRIPTION OF THE DRAWINGS

The above aspects, and other features and advantages of the present invention will become more apparent after reading the following detailed description when taken in conjunction with the drawings, in which.

DETAILED DESCRIPTION OF THE ILLUSTRATIVE, NON-LIMITING EMBODIMENTS OF THE INVENTION

Hereinafter, an illustrative, non-limiting embodiment of the present invention will be described in detail with reference to the accompanying drawings.

Figure 1:
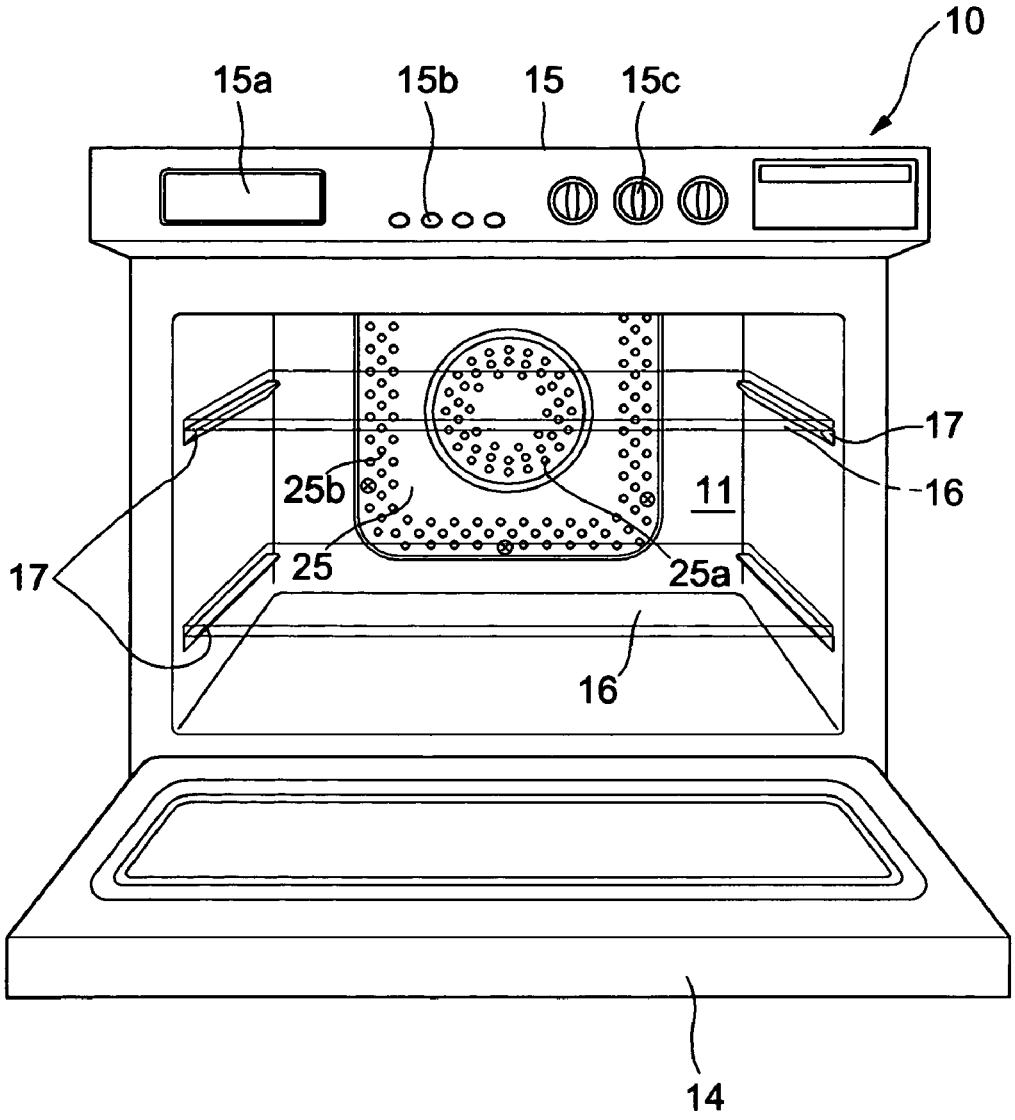
FIG. 1 is a perspective view illustrating the structure of a cooking device consistent with an exemplary embodiment of the present invention.
Figure 2:
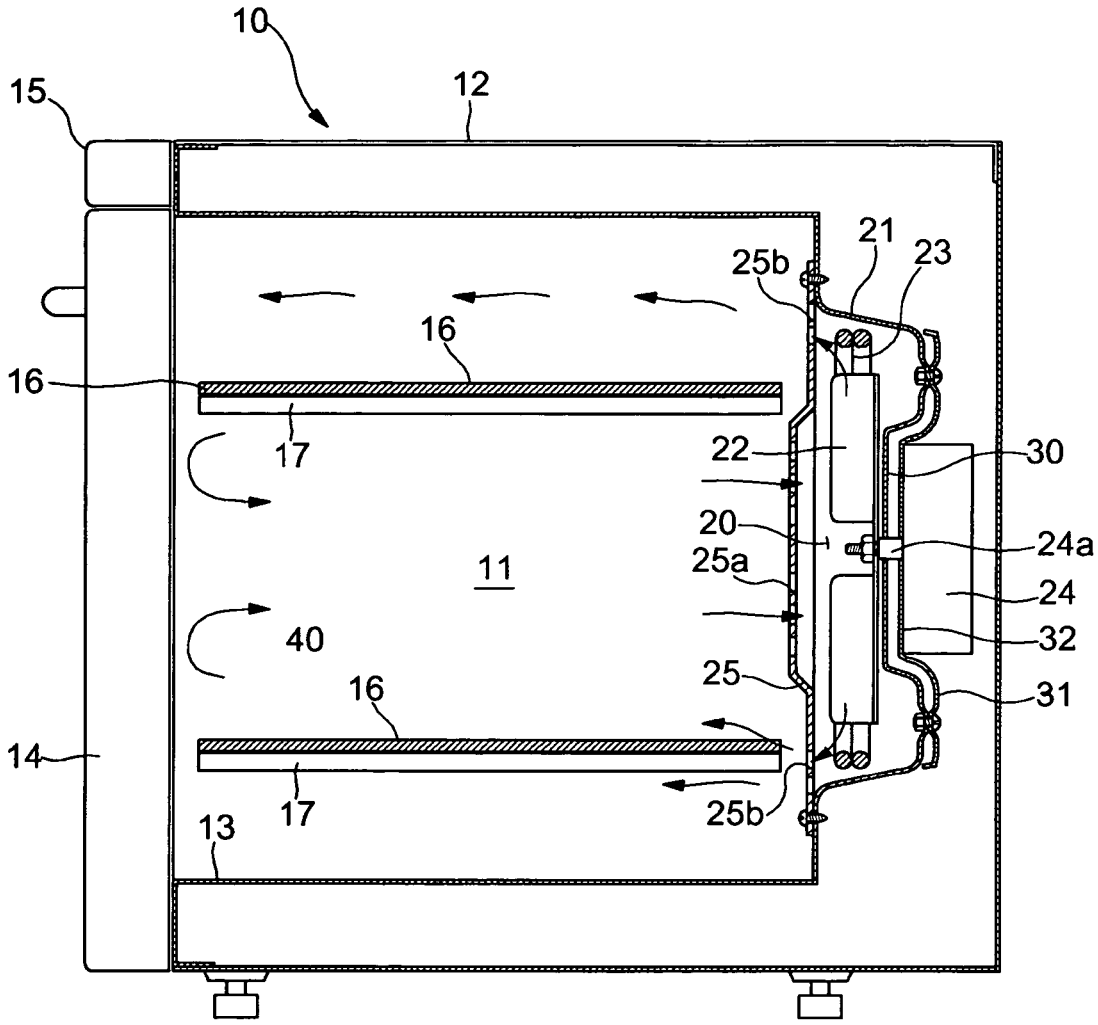
FIG. 2 is a sectional view illustrating the internal structure of the cooking device according to the exemplary embodiment of the present invention.

A cooking device according to the exemplary embodiment of the present invention, as shown in FIGS. 1 and 2, includes a main body 10 having a cooking chamber 11 formed therein. The main body 10 includes a steel outer case 12, and an inner case 13 spaced apart from the outer case 12 and defining the cooking chamber 11. The cooking chamber 11 has an open front side through which food is placed and withdrawn.

The open front side of the main body 10 is installed with a door 14 pivoted in the vertical direction to open and close the cooking chamber 11, and a manipulation panel 15 including a display 15*a* for displaying an operation state of the cooking device, manipulation buttons 15*b*, and manipulation switches 15*c* is provided at the upper side of the door 14.

Shelves 16 for storing food are provided at the inner upper and lower sides of the cooking chamber 11. The shelves 16 are supported by guide rails 17 installed in the inner sides of the inner case 13, slide along the guide rails 17, and are attached to or detached from the cooking chamber 11 like drawers.

Figure 3:
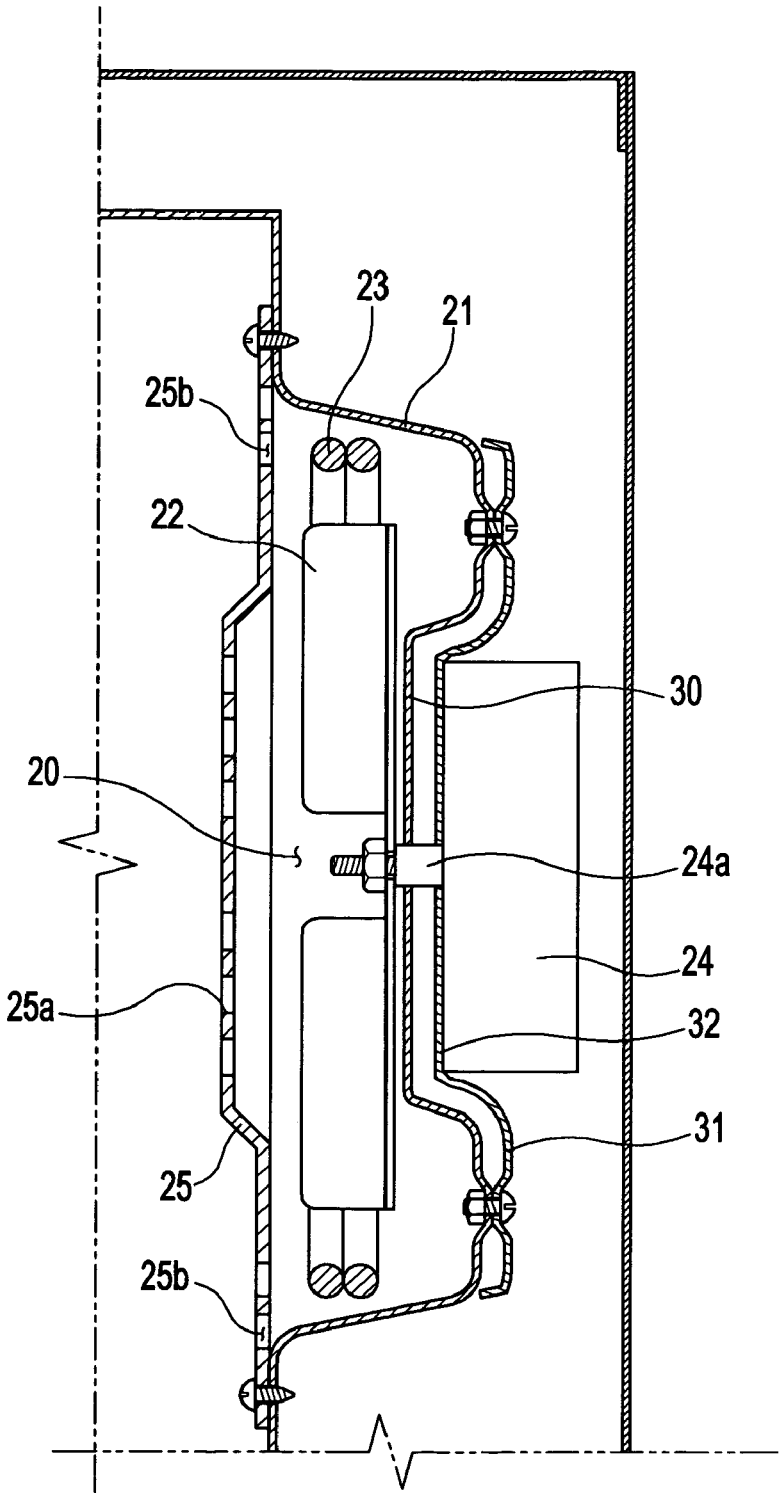
FIG. 3 is a detailed view illustrating main parts of the cooking device according to the exemplary embodiment of the present invention.

The cooking chamber 11, as shown in FIGS. 2 and 3, is provided with a heater case 21 at the inner rear side thereof, which is sunken from the rear surface of the inner case 13 toward the rear side of the cooking chamber 11 by a predetermined depth so as to form a heater room 20. The heater room 20 includes a circulation fan 22 for circulating air in the cooking chamber 11 and a heater 23 installed at the outside of the circulation fan 22 and heating the circulating air. A motor 24 for driving the circulation fan 22 in the heater room 20 is mounted on the rear surface of the heater case 21. The heater room 20 also includes a heater room cover 25 installed at the front side thereof and partitioning the cooking chamber 11 into the cooking chamber 11 and the heater room 20. The heater room cover 25 includes a plurality of first penetrating holes 25*a* formed in the central portion thereof such that air in the cooking chamber 11 enters the heater room 20, and a plurality of second penetrating holes 25*b* formed along the outer circumference thereof such that air passing through the heater room 20 is discharged into the cooking chamber 11.

The circulation fan 22 installed in the heater room 20 comprises a centrifugal fan for sucking air through its central portion and discharging air in the radial direction. The heater 23 is disposed around the circulation fan 22 at a distance from the circulation fan in a ring-shaped form to heat air blown by the circulation fan 22. Moreover, the heater 23 is spaced apart from the inner rear surface and rim of the heater room 20 such that the heating of the circulating air is facilitated.

In the cooking device, when the circulation fan 22 in the heater room 20 is driven by the motor 24, air in the cooking chamber 11 is sucked into the central portion of the circulation fan 22 of the heater room 20 and is expelled by the circulation fan 22 in the heater room 20. Air blown from the inside of the heater room 20 to the outside of the circulation fan 22 is heated by the heater 23 and supplied into the cooking chamber 11, thereby heating the inside of the cooking chamber 11. Thus, food placed on the shelves 16 in the cooking chamber 11 by a user is cooked.

Moreover, the cooking chamber according to the exemplary embodiment of the present invention, as shown in FIG. 3, includes a sunken part 30 formed such that a portion of the heater case 21 on which the motor 24 is mounted is sunken inward with respect to the heater room 20 by a predetermined depth. The sunken part 30 is integrally formed with the heater case 21, when the heater case 21 is made of a steel plate, via pressing. The heater case 21 is installed with a rear plate 31 spaced apart from the outer surface of the heater case 21 such that the outer surface of the heater case 21 is insulated. The rear plate 31 has a sunken part 32 sunken inward with respect to the heater room 20 and having a shape corresponding to the sunken part 30 of the heater case 21. The motor 24 is installed in the sunken part 32 such that a part of the motor 24 is received in the sunken part 32. A rotating shaft 24*a* of the motor 24 penetrates the rear plate 31 and the heater case 21 into the heater room 20 and is connected to the circulation fan 22.

The mounting structure of the motor 24 is constructed such that the sunken part 30 of the heater case 21 accommodates the sunken part 32 of the rear plate 31 and the sunken part 32 of the rear plate 31 accommodates the part of the motor 24, thereby reducing the rear space of the heater case 21 of the conventional cooking device. In this structure, since the motor 24 protrudes from the rear of the heater case 21 less than the conventional cooking device, the volume of the rear side of the heater case 21 can be reduced. Therefore, the volume of the cooking device is reduced.

As described above, since the cooking device according to the exemplary embodiment of the present invention is structured such that the portion of the heater case, on which the motor is mounted, is sunken inward with respect to the heater room, the circulation fan in the heater room can be aligned with the heater. Thus, the majority of the air blown by the circulation fan is blown toward the heater, thereby enhancing the heating of air by the heater.

In addition, since a part of the motor is accommodated in the sunken parts of the heater case and the rear plate, the volume of the rear side of the heater case is reduced and the cooking device according to the exemplary embodiment of the present invention can be made in a small size.

Although exemplary embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A cooking device comprising:

an inner case;

a heater case provided in the inner case to form a heater room;

a circulation fan installed in the heater room;

a heater installed outside of the circulation fan in the heater room;

a motor mounted outside the heater case to drive the circulation fan;

a first sunken part formed such that a portion of the heater case, on which the motor is mounted, is sunken inward with respect to the heater room by a predetermined depth; and a rear plate spaced apart from an outer surface of the heater case and insulating the outer surface of the heater case, wherein the rear plate includes a second sunken part corresponding to the first sunken part and sunken inward with respect to the heater room, and wherein an inner end face of the motor is accommodated in and lies flush against the second sunken part of the rear plate.

2. The cooking device according to claim 1, wherein the heater case is integrally formed with the first sunken part.

3. The cooking device as claimed in claim 1, wherein the heater is aligned in an air blowing direction of the circulation fan.

* * * * *